US005505507A

United States Patent [19]

Natali

[11] Patent Number: 5,505,507

[45] Date of Patent: Apr. 9, 1996

[54] SPRING-LOADED DOOR-CLOSING DEVICE

[75] Inventor: Gianfranco Natali, Umbertide, Italy

[73] Assignee: Faist Componenti S.r.l., Montone, Italy

[21] Appl. No.: 354,138

[22] Filed: Dec. 6, 1994

[30] Foreign Application Priority Data

Dec. 20, 1993 [IT] Italy ..... AR93U0032 U

[51] Int. Cl.[6] ..... E05C 17/44

[52] U.S. Cl. ..... 292/338; 292/DIG. 15

[58] Field of Search ..... 292/259 R, 259 A, 292/338, 339, 288, 289, DIG. 15

[56] References Cited

U.S. PATENT DOCUMENTS

| | | | |
|---|---|---|---|
| 475,686 | 5/1892 | Hauck | 292/DIG. 15 |
| 537,250 | 4/1895 | Tynon | 292/DIG. 15 |
| 4,050,723 | 9/1977 | Papadatos | 292/DIG. 15 |

FOREIGN PATENT DOCUMENTS

| | | | |
|---|---|---|---|
| 2557097 | 6/1977 | Germany | 292/338 |
| 567495 | 11/1957 | Italy | 292/DIG. 15 |
| 2263303 | 7/1993 | United Kingdom | 292/DIG. 15 |

*Primary Examiner*—Steven N. Meyers
*Assistant Examiner*—Tuyet-Phuong Pham
*Attorney, Agent, or Firm*—Young & Thompson

[57] ABSTRACT

This invention is a spring-loaded door-closing device consisting of a section (1) having a longitudinal cavity (2) in the lower part which houses and allows a moving tube (15) attached to a pressure hook (16) and a reaction spring (18) to slide within. In the upper part of the section there are one or more longitudinal channels (5, 6), and one or more brackets (13) equipped with a structure for moving along, and fixing to, the channels (5, 6). The brackets have components for fixing them to the under part of a vehicle floor in such a position where they can hold open, when activated, the vehicle door, or doors.

8 Claims, 1 Drawing Sheet

SPRING-LOADED DOOR-CLOSING DEVICE

BACKGROUND OF THE INVENTION

This invention is a spring-loaded door-closing device, suitable for holding open a turning door and particularly suitable for fixing to the under part of floors of vehicles having one or more doors which need to be held in an open position during loading and unloading.

There are existing spring-loaded door-closing devices which are suitable for fixing under the loading floor of vehicles and which are activated when the side or rear door, or doors, of vehicles have to be held open. This is to allow the driver, or any workers, to load and unload goods without being inconvenienced by any turning movement of the doors. The doors are held firm by the above-mentioned hooks, in windy conditions too, usually in a position close to the vehicle sides, thus preventing any obstacle and/or danger to workers during work or the doors turning on their hinges to a point whereby they are in a dangerous position to people and/or vehicles passing close by or arriving unexpectedly.

Existing door-closing devices consist of a metal tubular structure to which two protruding mounting plates or brackets are welded. These brackets have holes to take screws or bolts for fixing the door-closing device to the vehicle structure. These brackets are normally under the floor and in such a position that the locking pressure hook, when at rest, does not overhang the outer profile of the vehicle. The length of the tubular structure is sufficient, however, to allow the moving tube attached to the hook to slide until it protrudes sufficiently to allow fastening, after being rotated, of the door needing to be secured.

The fastening action is effected by an internal helical spring which counters the sliding out of the moving part and tends to hold it inside the tubular support. This support also acts as a guide for this moving part without impeding the rotation necessary to move the hook on the end of the tube from the rest position to the operating position.

Existing devices possess a major defect in that each type is suitable has to be fitted on the vehicle for which it was designed.

Changing the vehicle type and in particular the distances between the fixing points on the vehicle, thus varying where the fixing plates or brackets must be positioned, involves replacing the door-closing device.

Manufacturers of door-closing devices must therefore build different types, with brackets at different mutual distances; they must dispatch to users the types suitable for the vehicle on which they are to be installed or else they must require users to alter the fixing methods of the devices, thereby complicating matters for both the manufacturer and the user.

SUMMARY OF THE INVENTION

The aim of this invention is the creation of a door-closing device having a fixing structure which is suitable for all vehicles. This allows the manufacturer to standardize production thereby reducing costs, simplifying storage and facilitating the dispatch of orders.

Such a door-closing hook is equally advantageous to the installer who, using the same device on different vehicles, will keep a smaller number in storage with a resulting lower capital investment.

The invention of a spring-loaded door-closing device with a fixing structure applying this concept has been accomplished in a device consisting of an extruded or pressed sheet metal section having a longitudinal cavity in the lower part which houses and allows a moving tube attached to a pressure hook and a reaction spring to slide within. In the upper part of the section there are one or more longitudinal channels, and one or more brackets equipped with means for moving along, and fixing to, the longitudinal channels in the section. The device also has suitably-shaped components for fixing it to the under part of the floor of the vehicle to which the device has to be mounted.

A door-closing device having a supporting structure and adjustable, possibly interchangeable, brackets is an advantage for the manufacturer since it is easy to make, has the same structure for different vehicles on which it is to be fitted, and also eliminates diversification of production, storage and dispatch. For the user, or assembler, it is advantageous because it allows the position of the two fixing plates, or brackets, on the section to be altered and hence it is adaptable to the vehicle on which it is to be fitted, whatever type of vehicle it may be, and also permits the use of brackets adapted for special applications without the needing to modify the main body of the device.

BRIEF DESCRIPTION OF THE DRAWINGS

The invention is described as follows with reference to the preferred manufactured shape shown as an example in the enclosed drawings, where.

It is to be understood that the drawings are examples only, serve to ease understanding of the invention and refer to the preferred manufactured shape.

DESCRIPTION OF THE PREFERRED EMBODIMENT

Figure 1:
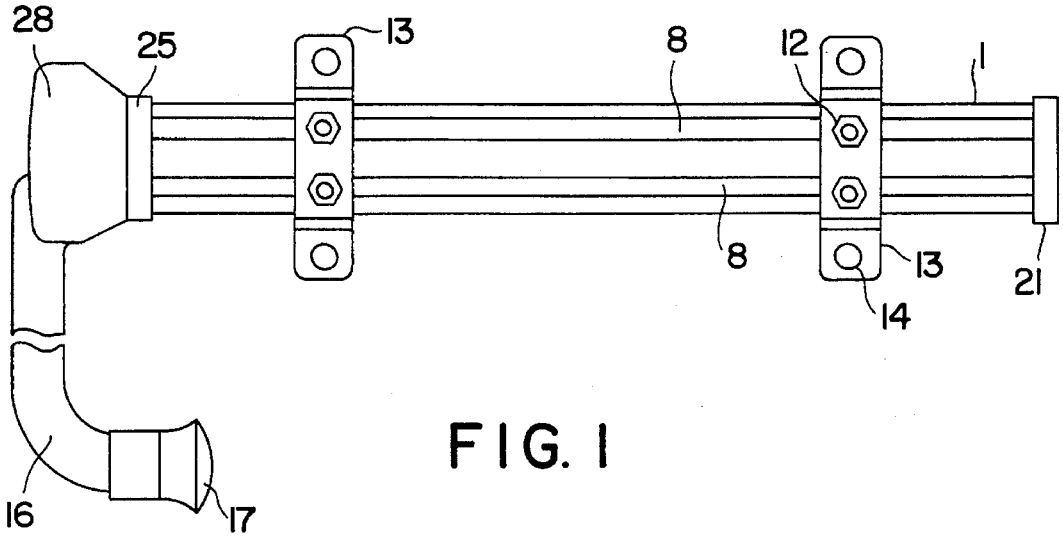
FIG. 1 shows the front view of the invention with the pressure hook in the rest position.
Figure 2:
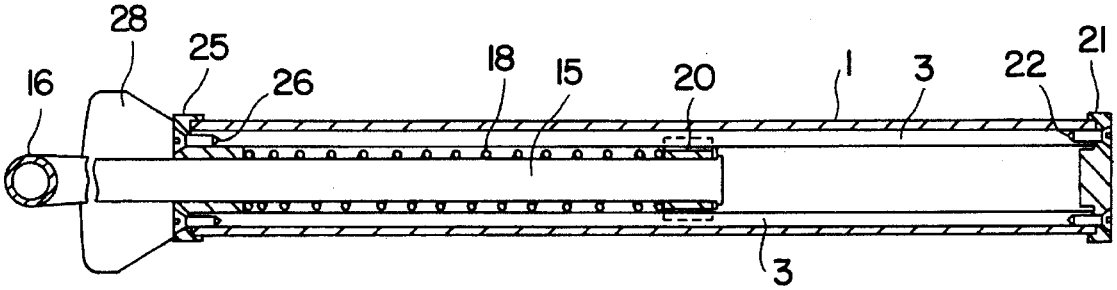
FIG. 2 shows the front view of the invention with the support section cut-away along the axial plane; the moving tube is partially withdrawn and the pressure hook is turned to the operating position.
Figure 3:
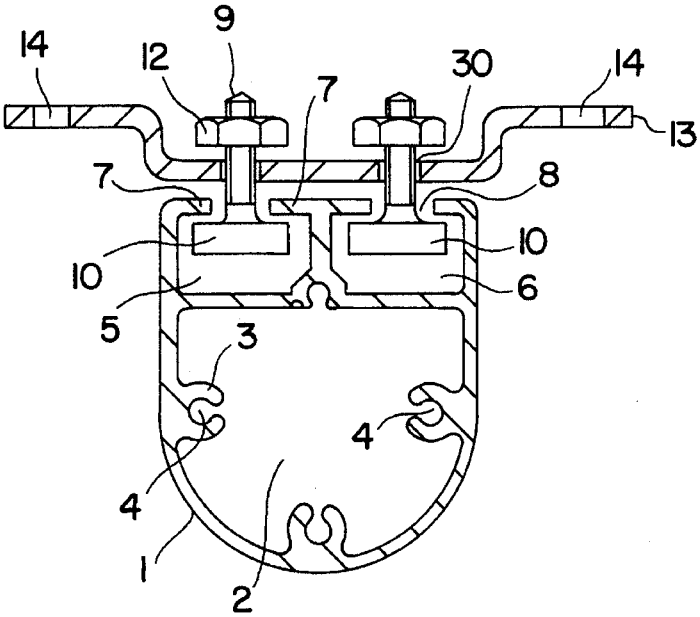
FIG. 3 shows a view in an axial direction, and at a different scale, cut on the transverse plane of the section where its configuration is shown together with the fixing system and the adjustment of the fastening plates or brackets.

In the drawings: 1 indicates the main body of the section, 2 indicates the lower longitudinal cavity with internal ribbing 3 with holes 4. 5 and 6 indicate the two longitudinal channels bounded above by the retaining fins 7. 8 indicates the longitudinal openings of the channels 5 and 6 within which the shanks 9 of the locking bolts can run —in the example in FIG. 3, the head of the locking bolt sits in, and can slide in, the above-mentioned channels. 12 indicates the nuts which attach to the threaded shanks 9.

13 indicates the plates, or brackets, with holes 14 to enable them to be fixed, directly or indirectly, to points positioned on the underlying part of the vehicle floor.

15 indicates the moving tube of the door-closing device while 16 indicates the hook-shaped projecting part. 17 indicates the cap on the end part of the hooked structure, and 18 indicates the reaction spring. 20 indicates the moving-tube guide boss which is positioned at the rear end of the moving tube on which the spring 18 acts when the pressure hook 16 is pulled towards the operating position. 21 indicates the rear end piece secured to the section 1 by screws 22 which are inserted into holes 4.

25 indicates the end piece which guides the moving tube 15 when sliding and which closes the section 1 to the front. 26 indicates the screws which fasten the end piece to the ribbing 3 while 28 indicates the moulded protrusions on the end piece 25 which serve to hold the pressure hook 16 in position when deactivated.

The supporting structure and fixing brackets, which allow the manufacture of a new door-closing device suitable for installing on different vehicles, consists therefore of a section 1, manufactured using an extrusion process, or through the joining of pressed metal sheets or through the joining together of extruded parts, with a lower longitudinal cavity 2 suitable for housing a moving tube 15 and a reaction spring 18 with longitudinal ribbing 3 placed inside the section as shown in the drawings, or, in an equivalent configuration, outside the section, and provided with axial holes 4 so as to interact with screws 22 and 26. This is so that the end pieces 21 and 25 may be fixed firmly, but remain removable. These end pieces close off the section at its ends and are intended to prevent the entry of extraneous matter which could obstruct the sliding action of the moving tube 15.

The end piece 25, which closes the section 1 to the front, also has protrusions 28, or forming, which allow it, when at rest, to unite with the hook 16, impede its rotation and hold it firm on a plane parallel to the floor of the vehicle in such a way as to impede it, under the action of its own weight, from turning towards the ground or to any position different from that desired.

The section 1 normally has two longitudinal channels 5 and 6 which allow the fixing parts of the brackets 13 to slide. There are normally two brackets.

The brackets are provided with suitable means for them to interact with the channels 5 and 6 in the section 1, thus allowing them to slide longitudinally when they are loose and to be firmly fixed to the section 1 when they are in the clamped state. The fixing system in the example shown in FIG. 3 consists of a bolt, whose head 10 is enclosed in the channels 5 and 6 and sized in such a way as to be able to slide inside these channels without being able to exit through the longitudinal openings 8, united with a nut 12 and possibly with elastic washers which improve the clamped state when, on tightening the nut 12, the bracket is gripped tightly against the section 1.

In another configuration, there are nuts, or small plates acting as nuts, which are housed inside the channels 5.

The brackets 13, in the preferred solution, have an outline profile in the shape of an inverted omega as shown in FIG. 3. This is so that the end parts of the brackets where normally holes 14 are made are at a higher level than the upper ends of the bolt shanks 9 so that they do not obstruct the direct or indirect joining to the part under the floor of the vehicle to which they must be fixed.

Therefore, in the configuration shown in the drawings on the attached sheet, the above-mentioned brackets 13 have at least two holes 30 in the centre for fixing them to the section 1 with bolts and two lateral holes 14 if the fixing to the vehicle is to be effected using nuts and bolts.

In equivalent configurations, the section 1 can have a single central upper channel 5, or more than two upper channels. It can be equipped with a single fixing bracket 13 or with more than two brackets. The method for fixing the brackets 13 to the section 1 can be, for example, by rivets which in this case, are riveted by the installer using the brackets in the desired position.

The brackets 13 have a profile which is also suitable for welding their ends to points lying on the under part of the floor of the vehicle to which they must be fixed.

Such points can be made from brackets which are the same as those for mounting and fixed in an inverted position on the underneath part of the floor of the vehicle with bolts, spot welds or other suitable means.

The material which the section 1 is made from can be metal or plastic material.

I claim:

1. A spring-loaded door-closing device, suitable for holding open a turning door and particularly suitable for fixing to the under part of floors of vehicles having at least one door which needs to be held in an open position during loading and unloading, characterized by a supporting structure furnished with a moving tube having an overhanging hook at one end elastically impeded from moving by a reaction spring within said supporting structure, characterized by the fact that the supporting structure is made with a section (1) having a longitudinal cavity (2) in a lower part which houses and allows said moving tube (15) and said reaction spring (18) to slide within said cavity having in an upper part of said section at least one longitudinal channel (5, 6) as well as being characterized by at least one bracket (13) equipped with means for moving along, and fixing to, said at least one channel (5, 6) in said section (1), and also having suitably-shaped components for fixing said at least one bracket to the floor of the vehicle to which it is to be mounted.

2. A spring-loaded door-closing device, as claimed in claim 1, characterized by said at least one bracket (13) having means for joining said at least one bracket to said at least one channel (5, 6) in said section (1) in such a way as to allow its longitudinal sliding when loose and to be firmly fixed to said section (1) when it is in a clamped state.

3. A spring-loaded door-closing device, as claimed in claim 1, characterized by the fact that said at least one bracket (13) has an outline profile in a shape of an inverted omega, and has at least two central holes (30) to attach it with bolts to said section (1).

4. A spring-loaded door-closing device, as claimed in claim 1, characterized by the fact that said at least one the bracket (13) has a profile which also allows its ends to be welded to points where it has to be fixed.

5. A spring-loaded door-closing device, as claimed in claim 1, characterized by the fact that said section (1) has a longitudinal ribbing (3) with an axial hole (4).

6. A spring-loaded door-closing device, as claimed in claim 1, characterized by the fact that said section (1) is closed at the extremities by removable end pieces (21,25).

7. A spring-loaded door-closing device, as claimed in claim 1, characterized by the fact that a front end piece (25) has a protrusion (28) which, when at rest, permits it to unite with said hook (16) and impede its rotation and hold it in position.

8. A spring-loaded door-closing device, as claimed in claim 1, characterized by the fact that said at least one bracket (13) is suitable for fixing to corresponding brackets mounted on the under-floor part of the vehicle.

* * * * *